United States Patent [19]

Polick et al.

[11] Patent Number: 4,714,103

[45] Date of Patent: Dec. 22, 1987

[54] CONTINUOUS CASTING MOLD

[75] Inventors: Raymond L. Polick, Pittsburgh; Kenneth D. Tamburrino, Aliquippa, both of Pa.; Edmund H. Becker, Schwerte, Fed. Rep. of Germany

[73] Assignee: Mannesmann Demag Corporation, Coraopolis, Pa.

[21] Appl. No.: 917,705

[22] Filed: Oct. 10, 1986

[51] Int. Cl.[4] ..... B22D 11/124

[52] U.S. Cl. ..... 164/486; 164/485; 164/459; 164/418; 164/443; 164/444

[58] Field of Search ..... 164/443, 485, 418, 459, 164/486, 444

[56] References Cited

U.S. PATENT DOCUMENTS

| | | | |
|---|---|---|---|
| 3,286,310 | 11/1966 | Dore | 22/57.2 |
| 3,289,257 | 12/1966 | Richards | 22/57.2 |
| 3,528,487 | 9/1970 | Wognum et al. | 164/280 |
| 3,693,697 | 9/1972 | Tzavaras | 164/56 |
| 3,811,490 | 5/1974 | Middleton et al. | 164/49 |
| 3,981,351 | 9/1976 | Dompas | 164/283 R |
| 4,136,728 | 1/1979 | Schmid | 164/444 |

FOREIGN PATENT DOCUMENTS

| | | | |
|---|---|---|---|
| 0155836 | 9/1985 | European Pat. Off. | 164/443 |
| 42-25544 | 12/1967 | Japan | 164/443 |
| 53-45777 | 12/1978 | Japan . | |

*Primary Examiner*—Kuang Y. Lin
*Attorney, Agent, or Firm*—Suzanne Kikel

[57] ABSTRACT

A varying length vibrating mold assembly for a continuous caster comprises a cooling jacket with an upper stationary portion and a lower removable portion. A tubular mold and an inner wall of the cooling jacket can be made to correspond to the varying length for the cooling jacket.

14 Claims, 5 Drawing Figures

CONTINUOUS CASTING MOLD

BACKGROUND OF THE INVENTION

This invention relates to a vibrating mold assembly and a method of operation, which mold assembly has a cooling jacket disposed around a mold tube for the continuous casting of metal billets. More particularly, the length for a mold assembly can be varied from one dimension to another by employing different lengths molds in combination with attaching or detaching extensions to the mold assembly especially the cooling jacket, and replacing the inner wall of the cooling jacket and the mold.

Present day continuous casting, vibrating mold assemblies for casting metals, such as ferrous metals, are conventionally of a fixed length. This fixed length for the mold assembly is usually selected based on the solidification rate of metal with a low carbon content. This fixed length is such that it insures that sufficient wall portions of the casting freeze are thick enough so that the casting skin does not break thereby allowing the molten metal from the core to pour out of the casting.

If metals with carbon levels, particularly in a medium range particularly between 0.15 and 0.35 and higher are being cast using the open stream-mold oil practice, the molten metal solidifies unevenly. The metal shrinks away from the mold unevenly and faster than the low carbon metals thereby causing the solidification to become uneven resulting in an unacceptable product shape. The longer the casting mold, the longer the metal shell is in the mold. This added time makes the already uneven solidified shell worse because of the cooling influence of the water cooled copper tube.

The mold tubes of present day fixed length mold assemblies similar to those mentioned above for casting steel metals are usually made of copper. These copper mold tubes have a tendency to quickly wear in the lower section which then have to be discarded, resulting in high replacement costs for the mold tube.

These aforesaid limitations of a fixed length mold assembly for casting both relatively low and high carbon steels is further explained in U.S. Pat. No. 3,528,487. There is therefore a need in the industry to be able to adapt a mold assembly to a length which would permit sufficient mold time proportional to the solidification rate and carbon range of the different carbon content metals. There is a further need in the art to provide a copper mold tube which can be salvaged when a section of the tube wears.

SUMMARY OF THE INVENTION

It is therefore an object of the present invention to provide a mold assembly and a method of operation, which mold assembly has the flexibility to provide the mold time necessary to accommodate the solidification rates of the metals having different chemical compositions, thereby providing quality products. Such a mold assembly is being provided which can be adapted quickly and efficiently.

It is a further object of the present invention to provide a mold assembly with a varying length such that when the longer mold tube wears, at its lower section, it can be shortened and placed in a mold assembly used for casting a product needing a shorter mold time.

A broad object of the present invention is to provide a mold assembly having the flexibility for the required length change in casting different chemical composition metals thereby proving to be very cost effective for the industry.

A mold assembly of a cooling jacket type consists of a stationary cooling jacket and a removable cooling jacket portin. Both cooling jacket portions have flange members which interconnect and are bolted together to the mold assembly for the removable portion's attachment to the stationary portion. A flange connection also attaches the removable cooling jacket portion to a part of a secondary cooling unit of the continuous caster. The flanges of both the stationary cooling jacket and the secondary cooling unit are such that they interfit for connection thereto upon the removal of the removal cooling jacket portion.

A still further object of the present invention is to provide a flange connection such that the cooling jacket of the mold assembly is adequately connected to a portion of the secondary cooling unit with or without the removable cooling jacket portion. A tubular mold and an inner wall for the cooling jacket adjacent to the tubular mold may be easily shortened or completely replaced so that their lengths generally correspond to the cooling jacket.

A still further object of the invention is to provide a portion of a secondary cooling unit attachable to the mold assembly and a further cooling means provided between this attachable cooling unit and a fixed part of the secondary cooling unit when a shorter mold assembly is being used.

DETAILED DESCRIPTION OF A PREFERRED EMBODIMENT

Figure 1:
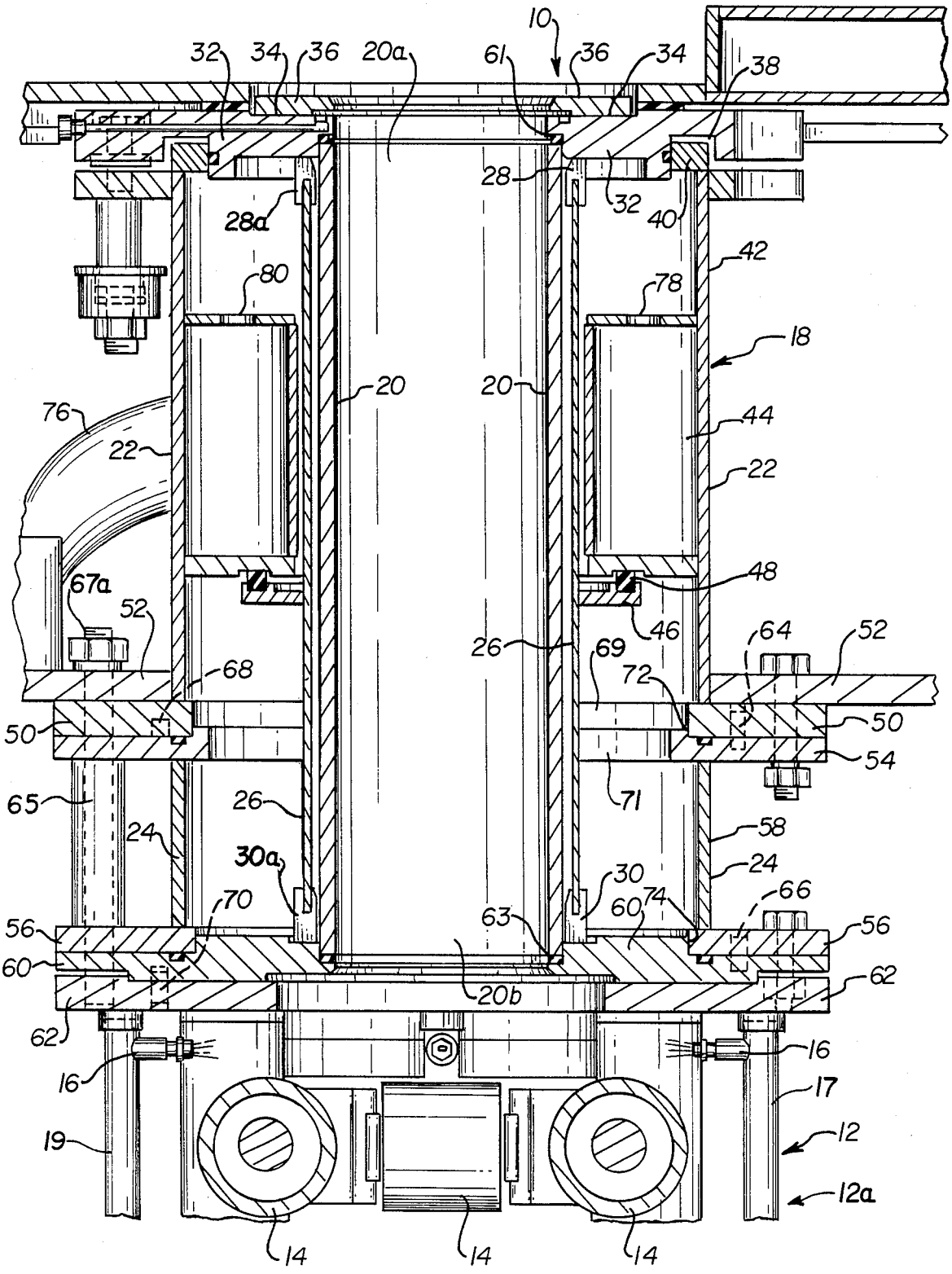
FIG. 1 illustrates a mold assembly of the present invention including a removable lower portion.
Figure 2:
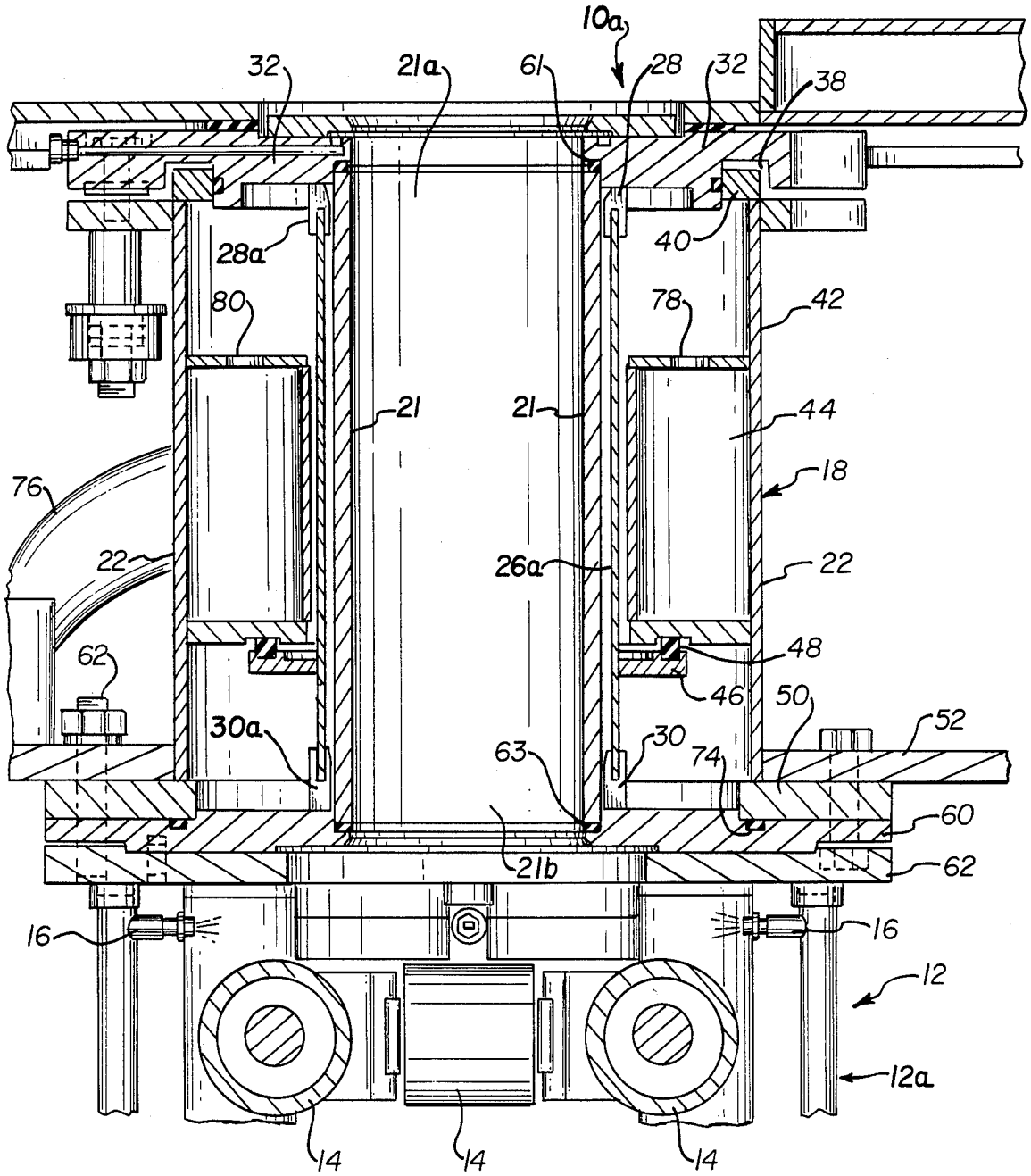
FIG. 2 illustrates a mold assembly of the present invention excluding the removable lower portion.

FIGS. 1 and 2 represent a mold assembly 10 which is caused to vibrate through suitable means (not shown) and which mold receives molten metal such as steel. In a manner well-known in continuous casting plants, the molten metal is brought by ladles and poured into tundishes which direct the flow into mold assembly 10. The mold assembly 10 is caused to vibrate in order to loosen the skin away from the wall of mold assembly 10 during the solidification phase of the metal and to stir the metal therein.

The initial solidification phase occurs in mold assembly 10 and further hardening of the core is done in a secondary cooling unit 12 located beneath mold assembly 10. Cooling unit 12 consists of a plurality of rollers 14 and spray units 16 which are also conventional in continuous casting plants. As shown particularly in FIGS. 3*a* and 3*b*, secondary cooling unit consists of two sections 12*a* and 12*b*, where section 12*a* is immediately adjacent to the bottom of mold assembly 10, and section 12*b* is located down from section 12*a*, more about which will be discussed shortly. Background for continuous casting practice is further exemplified in U.S. Pat. Nos. 3,289,257 and 3,811,490 which are incorporated herein by reference.

The mold assembly 10 in FIG. 1 will usually be used when casting metals which may be referred to as being high alloy; whereas the mold assembly 10 in FIG. 2 is shorter, not having an extension, and will usually be used when casting low carbon metals usually in the range between 0.15 to 0.35 percent particularly when casting with an oil lubricant. The numerals in FIGS. 1 and 2 represent the same components therein.

The mold assembly, 10, 10a shown in FIGS. 1 and 2 respectively comprise a cooling jacket 18 encircling a tubular copper mold 20, 21. Mold 20, 21 has a cavity with opposed ends 20*a*, 20*b* and 21*a*, 21*b*: the top end 20*a*, 21*a* for receiving molten metal and the lower end 20*b*, 21*b* for progressively discharging the metal in billet form which then travels into cooling zone 12. Cooling jacket 18 of FIGS. 1 and 2 consists of a stationary upper portion 22 and, that of FIG. 1 consists of a removable lower portion 24 which acts as an extension to give length to stationary portion 22.

Both stationary and removable portions 22, 24 are formed, in part, by an inner wall member 26, 26*a* extending substantially the length of tubular mold 20, 21 and located adjacent to and spaced away from mold 20, 21. Accurate spacing and alignment of inner wall member 26, 26*a* of cooling jacket 18 is accomplished through a plurality of spacer elements arranged around and located at the top and bottom, respectively of inner annular wall member 26, 26*a*. Such spacer elements are indicated at 28, 28*a* at the top of wall members 26, 26*a* and 30, 30*a* at the bottom thereof.

Spacers 28, 28*a* abut against an upper surface of an annular member 32 which partially forms the top of stationary upper portion 22. Annular member 32 has an inner top shoulder 34 for supporting ring 36 forming the entrance to the cavity in mold 20, 21 and an outer undersurface cut-out area 38 for receiving collar 40 for an outer wall member 42 of stationary upper portion 22. Portion 22 houses an annular baffle 44 formed, in part, and mounted to outer wall member 42. Baffle 44 has an inlet section and a coolant outlet section, which sections are not shown in the Figures. an annular member 46 mounted to inner wall 26, 26*a* beneath baffle 44 supports a gasket 48. Members 26 or 26*a*, 28 and 48 are of a one-piece fabricated construction. Coolant flows into stationary portion 22 and with reference to the mold assembly of FIG. 1 into removable portion 24. The coolant flows between spacers 30 beneath inner wall 26 or 26*a*, and fills up into the space between mold 20 and inner wall 26*a* of FIG. 2. The coolant continues to flow through spacers 28 at the top of annular wall member 26, 26*a* back into the outlet section of baffle 44 in stationary portion 22.

The lower terminus of stationary portion 22 has an annular flange element 50 whose top surface in FIG. 1 abuts a supporting member 52 and whose undersurface forms a connection either to extension 24 as shown in FIG. 1 or section 12*a* of secondary coolant unit 12 as shown in FIG. 2, more about which will be discussed shortly.

The length of cooling jacket 18 is extended by using extension or removable portion 24. As shown in FIG. 1, removable portion 24 consists of an upper annular flange 54 and a lower annular flange 56 spaced away from flange 54 by an outer wall member 58. An enclosure for removable portion 24 is made by inner wall member 26 extending the length of removable portion 24, and an annular member 60 which supports lower flange 56 and spacer elements 30, 30*a*, and forms a base for mold assembly 10 in FIG. 1. Base member 60, in turn, is connected to annular member 62 which is part of section 12*a* of cooling unit 12 of both mold assemblies 10, 10*a* of FIGS. 1 and 2 respectively. In FIGS. 1 and 2, tubular mold 20, 21 is supported in annular member 32 at its top and at its bottom by annular member 60, and a seal is created therebetween through annular gaskets 61, 63 located at the top and bottom, respectively, of mold assemblies 10, 10*a*.

Coolant is delivered to spray units 16 of secondary cooling unit 12*a* of FIGS. 1 and 2, through pipe 17, 19. Even though not shown in these FIGS. 1 and 2, several sprays 16 are arranged along both sides of cooling unit 12*a*, as well as another row of rollers 14 as particularly shown in FIG. 3.

Flanges 54 and 56 of removable portion 24 are fastened by bolts to flange 50 and annular member 60, respectively as shown to the right of FIG. 1. As shown to the left of FIG. 1, a more stabilizing effect between the flanges 54 and 56 of the removable portion is accomplished through the use of sleeve 65 and a bolt 67 extending down through supporting member 52, annular flange 50, flanges 54 and 56, base member 60 and member 62. Alignment of these various components is done by dowel pins indicated at 64, 66, 68 and 70. The coolant discussed previously flows through annular openings 69, 71 shown particularly in FIG. 1. Opening 69 is formed by member 50 and inner wall 26 and opening 71 is formed by member 54 and wall member 26 (FIG. 1).

As can be seen in FIGS. 1 and 2, flange 54 of removable portion 24 has an extended inward lip 72 and base member 60 has a similar lip portion 74. These lips 72, 74 act to properly seat removable portion 24 between stationary upper portion 22 and section 12*a* of cooling unit 12. As can also be seen, particularly in FIG. 2, flange 50 of upper portion 22 has an undersurface area corresponding to that of flange 56 of removable portion 24 so that it can be properly seated into section 12*a* of cooling unit 12 when removable portion 24 is removed.

Cooling fluid is delivered to cooling jacket 18 through coolant inlet and outlet pipe which communicates with baffle 44. For removal of the coolant a plurality of openings, two of which are indicated at 78, 80 are provided in baffle assembly 10, 10*a*.

Referring again to FIG. 1, tubular mold 20 and inner wall 26 extend the length of the mold assembly 10 containing the removable portion 24 for its extension. As FIG. 2 shows these components 20 and 26 are replaced by components 21, 26*a* respectively which also extend the length of mold assembly 10*a*. These components 21, 26*a* in FIG. 2 have a length less than those of FIG. 1 and are mounted in mold assembly 10*a* such that they can be easily replaced to accommodate the length of the mold assembly being used. Where the longer length mold 20 and inner wall 26 of FIG. 1 are used, and begin to wear at their lower areas, these worn areas of components 20, 26 can be cut off. Once shortened, they can be put back into service in the shorter version of mold assembly 10*a* of FIG. 2.

As mentioned above, the mold assembly 10 of FIG. 1 will be used when casting very low carbon steel grades in a range approximately between 0.15 and lower. When casting higher carbon steels using the open stream-oil casting practice, which is well-known in the industry, the mold assembly 10*a* of FIG. 2 will be used wherein the removable lower portion 24 of cooling jacket 18 has been removed. This portion 24 of FIG. 1 is easily removed through obvious steps, and annular member 60 is caused to mate with annular flange element 50 which is part of stationary cooling portion 22 of cooling jacket 18 as shown in FIG. 2.

In the casting operation for both mold assemblies 10 in FIGS. 1 and 2, in a conventioal manner the molten metal is poured into the vibrating tubular mold 20, 21. Freezing of the outer walls of the molten metal occurs upon its contact with the tubular mold 20, 21 and the solidification process gradually occurs toward the core upon the casting's travel down through the mold. Upon its exit from mold assembly **10, 10*a* the formed billet enters secondary cooling unit 12**.

Figures 3A, 3B:
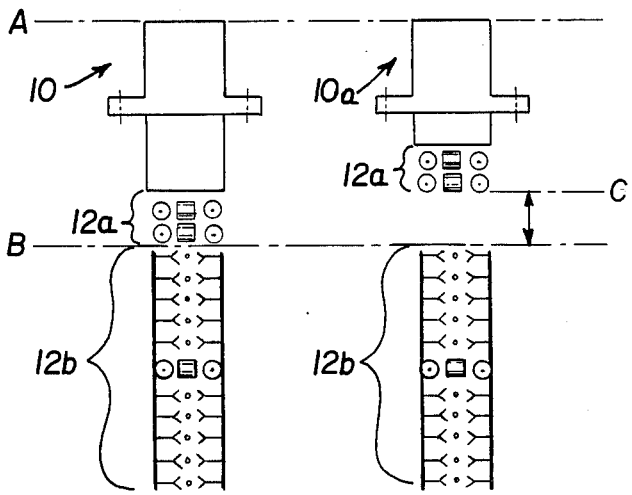
FIGS. 3A and 3B show two schematics of a mold assembly 10, 10*a* of the present invention having an affixed cooling section 12*a* and illustrating its positioning relative to section 12*b* of secondary cooling unit 12.

FIGS. **3*a* and 3*b* show schematics of mold assembly 10, 10*a*, respectively relative to secondary cooling unit 12. The schematic in FIG. 3*a* is that of mold assembly 10 of FIG. 1 containing removable portion 24 and cooling section 12*a*. This cooling section 12*a* is affixed to mold assembly 10 through means explained above and consists of two rows of rollers 14, and pipes 17, 19 with sprays 16. The bottom of this schematic illustrates permanent cooling unit 12*b* of secondary cooling unit 12**.

Figure 4:
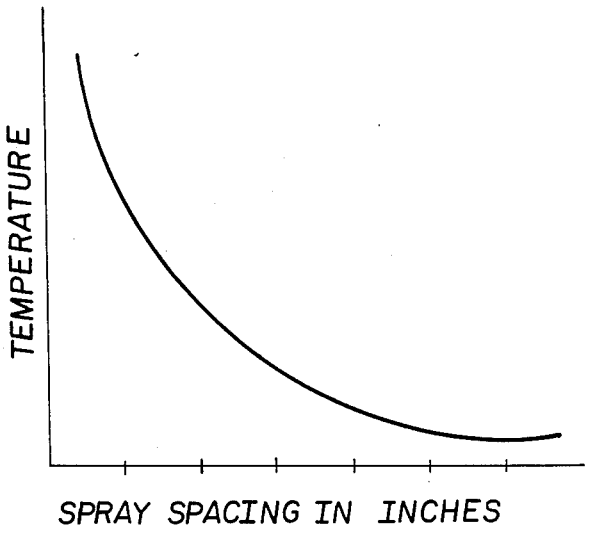
FIG. 4 illustrates a cooling curve obtained by the secondary cooling units 12*a* and 12*b* of FIGS. 3A and 3B.

The schematic of FIG. **3*b* illustrates mold assembly 10*a* of FIG. 2 without lower removable mold assembly section 24. Cooling section 12*a* is affixed to mold assembly 10*a* as shown in FIG. 2. The positioning of mold assembly 10, 10*a* in these two schematics is along a common molten metal feed line indicated by "A" which is set in the plant. As mentioned previously, the secondary cooling unit 12*b* is also a permanent construction in the continuous casting plant whose terminus for an uppermost plane is indicated by line "B". When the mold assembly 10*a* of FIG. 2 is used, along with its cooling portion 12*a*, a gap between lines B and C is formed as indicated by the double headed arrow in FIG. 3*b*. In order for the desired cooling curve shown in FIG. 4 to be obtained when using mold assembly 10*a*, filler means such as additional spraying units predeterminedly spaced and similar to those in unit 12*b*** are provided in this gap B-C so that a predetermined cooling patterned is maintained.

While considerable emphasis has been placed herein on the referred embodiment disclosed and described, it will be appreciated that many embodiments of the invention can be made and many changes can be made in the preferred embodiment without departing from the scope and spirit of the present invention. For instance, mold 20, 21 and inner wall member **26, 26*a* of cooling jacket 18 can each be a two-sectional arrangement where the two sections are fastened together through suitable means such that when the shorter version for mold assembly 10 in FIG. 2 is required, the lower section from each component 20, 26 can be easily sheared off making them substantially the same length as the mold assembly 10*a* of FIG. 2**.

In accordance with the patent statutes, we have explained the operation and principles of our invention, and have described and illustrated what we consider to be the best embodiment thereof.

We claim:

1. A device in the continuous casting of molten metal comprising:

a mold assembly, comprising:

mold member means having a wall cavity throughout with opposed opened ends, one end for receiving said molten metal and the other end for progressively discharging said metal in a cast form which cast form has an outer surface which separates away from said wall cavity upon solidification thereof, said mold member means including at least two different lengths of mold members, first cooling means disposed around said mold member means for receiving and distributing coolant to effect said solidification of said molten metal, fluid inlet means for introducing said coolant into said mold assembly, said first cooling means having inner wall means disposed around and adjacent to said mold member means between which said coolant travels, said inner wall means including at least two different lengths of inner walls which correspond to that of said mold members, annular extension means connectable to at least said first cooling means for extending the length of said mold assembly, and mounting means in said mold assembly for said mold member means and said inner wall means of said first cooling means for replacement of said mold member and of said inner wall in said mold assembly with a different mold member and a different inner wall for said first cooling means, each being selected such as to have a length which corresponds to that of said mold assembly, which length of said mold assembly is dependent on the use or non-use of said extension means, whereby a longer length for said mold member means and said inner wall means used in conjunction with said extension means provides a longer solidification period for said separating of said cast form surface from said wall cavity.

2. A device according to claim 1, further comprising:

second cooling means disposed adjacent to said discharging end of said mold member to receive and to provide a further cooling effect to said cast form;

said second cooling means comprising an upper portion attached to said mold assembly and having a plurality of rollers and sprays.

3. A device according to claim 2, wherein said second cooling means further comprises a stationarily mounted lower portion having a plurality of rollers and sprays and disposed relative to said upper portion whereby the spacing between said upper portion and said lower portion of said second cooling means varies in said use or non-use of said extension means on said mold assembly, and said spacing is greater in said non-use of said extension means.

4. A device according to claim 3, further comprising:

filler means disposed in said spacing in said non-use of said extension means, said filler means consisting of cooling spray units maintaining a predetermined cooling pattern in said cast form.

5. A device according to claim 1, further comprising:

an upper annular member forming an entrance at said receiving end of said mold member, a base annular member forming an exit at said discharging end of said mold member, said upper and base annular members being a part of said first cooling means, and wherein said mounting means for said mold member and said inner wall means are located in said upper and base annular members.

6. A device according to claim 1, wherein said first cooling means is a permanent part of said devie and comprises a first annular flange member at its base.

7. A device according to claim 6 further comprising a second cooling means located adjacent to said first cooling means for further cooling and solidification of said casting form and having a second annular flange means with a surface area shaped in a manner to properly seat said first annular flange member of said first cooling means for connection of said second cooling means to said first cooling means.

8. A device according to claim 7, said annular extension means for said first cooling means comprising spaced-apart third and fourth annular flange members, said third annular flange member having a cut-out section shaped such as to properly seat said first annular base flange member of said first cooling means, and said fourth annular flange member having a surface area shaped such as to receive and properly seat said second annular flange means of said second cooling means.

9. A device according to claim 8, further comprising stabilizing means located between said spaced apart third and fourth annular flange members of said extension means for said first cooling means for adding stability thereto.

10. A continuous casting machine for casting an article from molten metal, comprising:

inner mold means outer mold means including at least two different lengths of mold members arranged around said inner mold means, said inner mold means including at least two different lengths of mold elements with different effective cooling lengths, said each mold element having an opening for receiving said molten metal at one of its ends and an opening for discharging said cast article at its opposite end, first cooling means connected to said outer mold means, including means for exposing the coolant of said first cooling means to said inner mold means, said outer mold means including means for selectively securing one or the other of said different length of mold elements of said inner mold means to said outer mold means at a common location for said molten metal receiving end of said each different length mold element, secondary cooling means having a portion arranged below said outer mold means and located at a common cast article receiving position for both of said different length mold elements, means arranged between said discharging end of either said different length mold elements and said portion of said secondary cooling means for applying coolant to said cast article as it issues from said different length mold elements, and for maintaining a predetermined coolant pattern to said cast article.

11. A continuous casting machine according to claim 10, further comprising support means for said inner and outer mold means including means for supporting said different length mold elements at said common location for said molten metal receiving end.

12. A continuous casting machine for casting an article from molten metal, comprising:

inner mold means, and outer mold means including at least two different lengths of mold members arranged around said inner mold means, said inner mold means including at least two different length mold elements with different effective cooling lengths, said each mold elements having an opening for receiving said molten metal at one of its ends and an opening for discharging said cast article at its opposite end, said outer mold means including means for selectively securing one or the other of said different length mold elements of said inner mold means to said outer mold means at a common location for said molten metal receiving end, of said each different length mold elements.

13. A method for the continuous casting of molten metal into a cast form, employing a casting machine with a mold assembly including at least two different length of mold members having a molten metal receiving end and a cast form discharging end, and with first cooling means having at least two different length inner wall means with different lengths and arranged around said mold member, the steps comprising:

introducing coolant between said inner wall means and said mold member to effect solidification of said molten metal, connecting an extension means to said first cooling means for increasing the solidification period for said metal, when using said extension means, replacing a shorter length mold member and a shorter length inner wall means with a longer length mold member and a longer length inner wall means, which longer lengths substantially correspond to the length of said first cooling means with said extension means connected thereto, and introducing said coolant between said longer length mold member and inner wall means.

14. A method according to claim 13, the steps further comprising:

selectively securing either said shorter and longer length mold members and inner wall means at said molten metal receiving end and at said cast form discharging end, introducing coolant to said cast form by a second cooling applying means having an upper and a lower portion and arranged below said mold assembly at said discharging end for both said shorter and longer length mold members and said shorter and longer length inner wall means, and maintaining a predetermined coolant applying pattern by said second cooling applying means irrespective of which length of said mold member and said inner wall means are employed.

* * * * *